US008428936B2

(12) United States Patent
Mittal et al.

(10) Patent No.: US 8,428,936 B2
(45) **Date of Patent: *Apr. 23, 2013**

(54) DECODER FOR AUDIO SIGNAL INCLUDING GENERIC AUDIO AND SPEECH FRAMES

(75) Inventors: Udar Mittal, Bangalore (IN); Jonathan A. Gibbs, Winchester (GB); James P. Ashley, Naperville, IL (US)

(73) Assignee: Motorola Mobility LLC, Libertyville, IL (US)

( * ) Notice: Subject to any disclaimer, the term of this patent is extended or adjusted under 35 U.S.C. 154(b) by 270 days.

This patent is subject to a terminal disclaimer.

(21) Appl. No.: 12/844,206

(22) Filed: Sep. 9, 2010

(65) Prior Publication Data

US 2011/0218799 A1 Sep. 8, 2011

(30) Foreign Application Priority Data

Mar. 5, 2010 (IN) ..... 218/KOL/2010

(51) Int. Cl.
*G10L 19/02* (2006.01)

(52) U.S. Cl.
USPC ..... 704/203

(58) Field of Classification Search ..... 704/203
See application file for complete search history.

(56) References Cited

U.S. PATENT DOCUMENTS

| | | | |
|---|---|---|---|
| 4,560,977 | A | 12/1985 | Murakami et al. |
| 4,670,851 | A | 6/1987 | Murakami et al. |
| 4,727,354 | A | 2/1988 | Lindsay |
| 4,853,778 | A | 8/1989 | Tanaka |
| 5,006,929 | A | 4/1991 | Barbero et al. |
| 5,067,152 | A | 11/1991 | Kisor et al. |
| 5,327,521 | A | 7/1994 | Savic et al. |
| 5,394,473 | A | 2/1995 | Davidson |
| 5,956,674 | A | 9/1999 | Smyth et al. |
| 6,108,626 | A | 8/2000 | Cellario et al. |
| 6,236,960 | B1 | 5/2001 | Peng et al. |
| 6,253,185 | B1 | 6/2001 | Arean et al. |
| 6,263,312 | B1 | 7/2001 | Kolesnik et al. |
| 6,304,196 | B1 | 10/2001 | Copeland et al. |
| 6,453,287 | B1 | 9/2002 | Unno et al. |
| 6,493,664 | B1 | 12/2002 | Uday Bhaskar et al. |
| 6,504,877 | B1 | 1/2003 | Lee |
| 6,593,872 | B2 | 7/2003 | Makino et al. |

(Continued)

FOREIGN PATENT DOCUMENTS

| | | |
|---|---|---|
| EP | 0932141 A2 | 7/1999 |
| EP | 1533789 A1 | 5/2005 |

(Continued)

OTHER PUBLICATIONS

Office Action for U.S. Appl. No. 12/345,141, mailed Sep. 19, 2011.

(Continued)

*Primary Examiner* — Jakieda Jackson

(57) ABSTRACT

A method for decoding audio frames includes producing a first frame of coded audio samples, producing at least a portion of a second frame of coded audio samples, generating audio gap filler samples based on parameters representative of a weighted segment of the first frame of coded audio samples or a weighted segment of the portion of the second frame of coded audio samples, and forming a sequence including the audio gap filler samples and the portion of the second frame of coded audio samples.

13 Claims, 7 Drawing Sheets

U.S. PATENT DOCUMENTS

| | | | | |
|---|---|---|---|---|
| 6,658,383 | B2 | 12/2003 | Koishida et al. | |
| 6,662,154 | B2 | 12/2003 | Mittal et al. | |
| 6,691,092 | B1 | 2/2004 | Udaya Bhaskar et al. | |
| 6,704,705 | B1 | 3/2004 | Kabal et al. | |
| 6,775,654 | B1 * | 8/2004 | Yokoyama et al. | 704/500 |
| 6,813,602 | B2 | 11/2004 | Thyssen | |
| 6,940,431 | B2 | 9/2005 | Hayami | |
| 6,975,253 | B1 | 12/2005 | Dominic | |
| 7,031,493 | B2 | 4/2006 | Fletcher et al. | |
| 7,130,796 | B2 | 10/2006 | Tasaki | |
| 7,161,507 | B2 | 1/2007 | Tomic | |
| 7,180,796 | B2 | 2/2007 | Tanzawa et al. | |
| 7,212,973 | B2 | 5/2007 | Toyama et al. | |
| 7,230,550 | B1 | 6/2007 | Mittal et al. | |
| 7,231,091 | B2 | 6/2007 | Keith | |
| 7,414,549 | B1 | 8/2008 | Yang et al. | |
| 7,461,106 | B2 | 12/2008 | Mittal et al. | |
| 7,761,290 | B2 | 7/2010 | Koishida et al. | |
| 7,840,411 | B2 | 11/2010 | Hotho et al. | |
| 7,885,819 | B2 | 2/2011 | Koishida et al. | |
| 7,889,103 | B2 | 2/2011 | Mittal et al. | |
| 2002/0052734 | A1 | 5/2002 | Unno et al. | |
| 2003/0004713 | A1 | 1/2003 | Makino et al. | |
| 2003/0009325 | A1 | 1/2003 | Kirchherr et al. | |
| 2003/0220783 | A1 | 11/2003 | Streich et al. | |
| 2004/0252768 | A1 | 12/2004 | Suzuki et al. | |
| 2005/0261893 | A1 | 11/2005 | Toyama et al. | |
| 2006/0022374 | A1 | 2/2006 | Chen et al. | |
| 2006/0047522 | A1 | 3/2006 | Ojanpera | |
| 2006/0173675 | A1 | 8/2006 | Ojanpera | |
| 2006/0190246 | A1 | 8/2006 | Park | |
| 2006/0241940 | A1 | 10/2006 | Ramprashad | |
| 2006/0265087 | A1 | 11/2006 | Philippe et al. | |
| 2007/0171944 | A1 | 7/2007 | Schuijers et al. | |
| 2007/0239294 | A1 | 10/2007 | Brueckner et al. | |
| 2007/0271102 | A1 | 11/2007 | Morii | |
| 2008/0065374 | A1 | 3/2008 | Mittal et al. | |
| 2008/0120096 | A1 | 5/2008 | Oh et al. | |
| 2009/0024398 | A1 | 1/2009 | Mittal et al. | |
| 2009/0030677 | A1 | 1/2009 | Yoshida | |
| 2009/0076829 | A1 | 3/2009 | Ragot et al. | |
| 2009/0100121 | A1 | 4/2009 | Mittal et al. | |
| 2009/0112607 | A1 | 4/2009 | Ashley et al. | |
| 2009/0234642 | A1 | 9/2009 | Mittal et al. | |
| 2009/0259477 | A1 | 10/2009 | Ashley et al. | |
| 2009/0276212 | A1 * | 11/2009 | Khalil et al. | 704/226 |
| 2009/0306992 | A1 | 12/2009 | Ragot et al. | |
| 2009/0326931 | A1 | 12/2009 | Ragot et al. | |
| 2010/0088090 | A1 | 4/2010 | Ramabadran | |
| 2010/0169087 | A1 | 7/2010 | Ashley et al. | |
| 2010/0169099 | A1 | 7/2010 | Ashley et al. | |
| 2010/0169100 | A1 | 7/2010 | Ashley et al. | |
| 2010/0169101 | A1 | 7/2010 | Ashley et al. | |
| 2011/0161087 | A1 | 6/2011 | Ashley et al. | |

FOREIGN PATENT DOCUMENTS

| | | | |
|---|---|---|---|
| EP | 1619664 | A1 | 1/2006 |
| EP | 1483759 | B1 | 9/2006 |
| EP | 1845519 | B1 | 9/2009 |
| EP | 1959431 | B1 | 6/2010 |
| WO | 9715983 | A1 | 5/1997 |
| WO | 03073741 | A2 | 9/2003 |
| WO | 2007063910 | A1 | 6/2007 |
| WO | 2008063035 | A1 | 5/2008 |
| WO | 2010003663 | A1 | 1/2010 |

OTHER PUBLICATIONS

Office Action for U.S. Appl. No. 12/345,165, mailed Sep. 1, 2011.
Office Action for U.S. Appl. No. 12/047,632, mailed Oct. 18, 2011.
Office Action for U.S. Appl. No. 12/187,423, mailed Sep. 30, 2011.
Office Action for U.S. Appl. No. 12/099,842, mailed Oct. 12, 2011.
Patent Cooperation Treaty, "PCT Search Report and Written Opinion of the International Searching Authority" for International Application No. PCT/US2011/0266400 Aug. 5, 2011, 11 pages.
Neuendorf, et al., "Unified Speech Audio Coding Scheme for High Quality oat Low Bitrates" ieee International Conference on Accoustics, Speech and Signal Processing, 2009, Apr. 19, 2009, 4 pages.
Mexican Patent Office, 2nd Office Action, Mexican Patent Application MX/a/2010/004479 dated Jan. 31, 2012, 5 pages.
Bruno Bessette: "Universal Speech/Audio Coding using Hybrid ACELP/TCX Techniques", Acoustics, Speech, and Signal Processing, 2005. Proceedings. (ICASSP '05). IEEE International Conference, Mar. 18-23, 2005, ISSN : III-301-III-304, Print ISBN: 0-78.
United States Patent and Trademark Office, "Non-Final Rejection" for U.S. Appl. No. 12/047,632 dated Mar. 2, 2011, 20 pages.
United States Patent and Trademark Office, "Non-Final Rejection" for U.S. Appl. No. 12/099,842 dated Apr. 15, 2011, 21 pages.
Ramo et al. "Quality Evaluation of the G.EV-VBR Speech Codec" Apr. 4, 2008, pp. 4745-4748.
Jelinek et al. "ITU-T G.EV-VBR Baseline Codec" Apr. 4, 2008, pp. 4749-4752.
Jelinek et al. "Classification-Based Techniques for Improving the Robustness of CELP Coders" 2007, pp. 1480-1484.
Fuchs et al. "A Speech Coder Post-Processor Controlled by Side-Information" 2005, pp. IV-433-IV-436.
J. Fessler, "Chapter 2; Discrete-time signals and systems" May 27, 2004, pp. 2.1-2.21.
Patent Cooperation Treaty, "PCT Search Report and Written Opinion of the International Searching Authority" for International Application No. PCT/US2011/026660 Jun. 15, 2011, 10 pages.
Virette et al "Adaptive Time-Frequency Resolution in Modulated Transform at Reduced Delay" ICASSP 2008; pp. 3781-3784.
Edler "Coding of Audio Signals with Overlapping Block Transform and Adaptive Window Functions"; Journal of Vibration and Low Voltage fnr; vol. 43, 1989, Section 3.1; pp. 252-256.
Princen et al., "Subband/Transform Coding Using Filter Bank Designs Based on Time Domain Aliasing Cancellation" IEEE 1987; pp. 2161-2164.
Ramprashad: "High Quality Embedded Wideband Speech Coding Using an Inherently Layered Coding Paradigm" Proceedings of International Conference on Acoustics, Speech, and Signal Processing, ICASSP 2000, vol. 2, Jun. 5-9, 2000 pp. 1145-1148.
Patent Cooperation Treaty, "PCT Search Report and Written Opinion of the International Searching Authority" for International Application No. PCT/US2008/077693 Dec. 15, 2008, 12 pages.
Kovesi et al.; "A Scalable Speech and Audio Coding Scheme with Continuous Bitrate Flexibility" Proceeding of International Conference on Acoustics, Speech, and Signal Processing, 2004, Piscataway, JY vol. 1, May 17, 2004 pp. 273-276.
Ramprashad: "Embedded Coding Using a Mixed Speech and Audio Coding Paradigm" International Journal of Speech Technology Kluwer Academic Publishers Netherlands, Vo. 2, No. 4, May 1999, pp. 359-372.
3GPP TS 26.290 v7.0.0 (Mar. 2007) 3rd Generation Partnership Project; Technical Speciification Group Service and System Aspects; Audio codec processing functions; Extended Adaptive Multi0Rate—Wideband (AMR-WB+) codec; Transcoding functions (Release 7).
International Telecommunication Union, G.729.1, Series G: Transmission Systems and Media, Digital Systems and Networks, Digital Terminal Equipments—Coding of analogue signals by methods other than PCM, G.729 based Embedded Variable bit-rate coder.
Chen et al.; "Adaptive Postifiltering for Quality Enhancement of Coded Speech" IEEE Transactions on Speech and Audio Processing, vol. 3, No. 1, Jan. 1995, pp. 59-71.
Chan et al.; "Frequency domain postfiltering for multiband excited linear predictive coding of speech" Electronics Letters, Jun. 6, 1996, vol. 32 No. 12; pp. 1061-1063.
Andersen et al.; "Reverse Water-Filling in Predictive Encoding of Speech" IEEE 1999 pp. 105-107.
Makinen et al., "AMR-WB+: a new audio coding standard for 3rd generation mobile audio service", In 2005 Proceedings IEEE International Conference on Acoustics, Speech and Signal Processing, vol. 2, pp. ii/1109-ii/1112, Mar. 18, 2005.
Faller et al., "Technical advances in digital audio radio broadcasting", Proceedings of the IEEE, vol. 90, No. 8, pp. 1303-1333, Aug. 1, 2002.
Salami et al., "Extended AMR-WB for High-Quality Audio on Mobile Devices", IEEE Communications Magazine, pp. 90-97, May 1, 2006.

Hung et al., Error-Resilient Pyramid Vector Quantization for Image Compression, IEEE Transactions on Image Processing, 1994 pp. 583-587.
Hung et al., Error-resilient pyramid vector quantization for image compression, IEEE Transactions on Image Processing, vol. 7, No. 10, Oct. 1, 1998.
Daniele Cadel, et al. "Pyramid Vector Coding for High Quality Audio Compression", IEEE 1997, pp. 343-346, Cefriel, Milano, Italy and Alcatel Telecom, Vimercate Italy.
Mittal et al., Coding unconstrained FCB excitation using combinatorial and Huffman codes, Speech Coding 2002 IEEE Workshop Proceedings, Oct. 1, 2002, pp. 129-131.
Ashley et al., Wideband coding of speech using a scalable pulse codebook, Speech Coding 2000 IEEE Workshop Proceedings, Sep. 1, 2000, pp. 148-150.
Patent Cooperation Treaty, "PCT Search Report and Written Opinion of the International Searching Authority" for International Application No. PCT/US07/74222 Jul. 23, 2008, 9 pages.
Patent Cooperation Treaty, "PCT Search Report and Written Opinion of the International Searching Authority" for International Application No. PCT/US2009/036479 Jul. 28, 2009, 15 pages.
Markas et al. "Multispectral Image Compression Algorithms"; Data Compression Conference, 1993; Snowbird, UT USA Mar. 30-Apr. 2, 1993; pp. 391-400.
Mittal et al., Low complexity factorial pulse coding of MDCT coefficients using approximation of combinatorial functions, Acoustics, Speech and Signal Processing, 2007. ICASSP 2007. IEEE International Conference on, Apr. 1, 2007, pp. I-289-I-292.
"Enhanced Variable Rate Codec, Speech Service Options 3, 68, and 70 for Wideband Spread Spectrum Digital Systems", 3GPP2 TSG-C Working Group 2, XX, XX, No. C. S0014-C, Jan. 1, 2007, pp. 1-5.
Boris Ya Ryabko et al.: "Fast and Efficient Construction of an Unbiased Random Sequence", IEEE Transactions on Information Theory, IEEE, US, vol. 46, No. 3, May 1, 2000, ISSN: 0018-9448, pp. 1090-1093.
Ratko V. Tomic: "Quantized Indexing: Background Information", May 16, 2006, URL: http://web.archive.org/web/20060516161324/www.1stworks.com/ref/TR/tr05-0625a.pdf, pp. 1-39.
Ido Tal et al.: "On Row-by-Row Coding for 2-D Constraints", Information Theory, 2006 IEEE International Symposium on, IEEE, PI, Jul. 1, 2006, pp. 1204-1208.
Patent Cooperation Treaty, "PCT Search Report and Written Opinion of the International Searching Authority" for International Application No. PCT/US2009/036481 Jul. 20, 2009, 15 pages.
Tancerel, L. et al., "Combined Speech and Audio Coding by Discrimination," In Proceedings of IEEE Workshop on Speech Coding, pp. 154-156, (2000).
Udar Mittal et al., "Decoder for Audio Signal Including Generic Audio and Speech Frames", U.S. Appl. No. 12/844,199, filed Jul. 27, 2010.
Patent Cooperation Treaty, "PCT Search Report and Written Opinion of the International Searching Authority" for International Application No. PCT/US2009/039984 Aug. 13, 2009, 14 pages.
United States Patent and Trademark Office, "Non-Final Office Action" for U.S. Appl. No. 12/196,414 dated Jun. 4, 2012, 9 pages.
Ratko V. Tomic: "Fast, Optimal Entropy Coder" 1stWorks Corporation Technical Report TR04-0815, Aug. 15, 2004, pp. 1-52.
European Patent Office, Supplementary Search Report for EPC Patent Application No. 07813290.9 dated Jan. 4, 2013, 8 pages.
Cover, T.M., "Enumerative Source Encoding" IEEE Transactions on Information Theory, IEEE Press, USA vol. IT-19, No. 1; Jan. 1, 1973, pp. 73-77.
MacKay, D., "Information Theory, Inference, and Learning Algorithms" in: "Information Theory, Inference, and Learning Algorithms", Jan. 1, 2004; pp. 1-10.
Korean Intellectual Property Office, Notice of Preliminary Rejection for Korean Patent Application No. 10-2010-0725140 dated Jan. 4, 2013.
Chinese Patent Office (SIPO), 1st Office Action for Chinese Patent Application No. 200980153318.0 dated Sep. 12, 2012, 6 pages.

* cited by examiner

DECODER FOR AUDIO SIGNAL INCLUDING GENERIC AUDIO AND SPEECH FRAMES

FIELD OF THE DISCLOSURE

The present disclosure relates generally to speech and audio processing and, more particularly, to a decoder for processing an audio signal including generic audio and speech frames.

BACKGROUND

Many audio signals may be classified as having more speech like characteristics or more generic audio characteristics more typical of music, tones, background noise, reverberant speech, etc. Codecs based on source-filter models that are suitable for processing speech signals do not process generic audio signals as effectively. Such codecs include Linear Predictive Coding (LPC) codecs like Code Excited Linear Prediction (CELP) coders. Speech coders tend to process speech signals low bit rates. Conversely, generic audio processing systems such as frequency domain transform codecs do not process speech signals very well. It is well known to provide a classifier or discriminator to determine, on a frame-by-frame basis, whether an audio signal is more or less speech like and to direct the signal to either a speech codec or a generic audio codec based on the classification. An audio signal processor capable of processing different signal types is sometimes referred to as a hybrid core codec.

However, transitioning between the processing of speech frames and generic audio frames using speech and generic audio codecs, respectively, is known to produce discontinuities in the form of audio gaps in the processed output signal. Such audio gaps are often perceptible at a user interface and are generally undesirable. Prior art FIG. 1 illustrates an audio gap produced between a processed speech frame and a processed generic audio frame in a sequence of output frames. FIG. 1 also illustrates, at 102, a sequence of input frames that may be classified as speech frames (m−2) and (m−1) followed by generic audio frames (m) and (m+1). The sample index n corresponds to the samples obtained at time n within the series of frames. For the purposes of this graph, a sample index of n=0 corresponds to the relative time in which the last sample of frame (m) is obtained. Here, frame (m) may be processed after 320 new samples have been accumulated, which are combined with 160 previously accumulated samples, for a total of 480 samples. In this example, the sampling frequency is 16 kHz and the corresponding frame size is 20 milliseconds, although many sampling rates and frame sizes are possible. The speech frames may be processed using Linear Predictive Coding (LPC) speech coding, wherein the LPC analysis windows are illustrated at 104. A processed speech frame (m−1) is illustrated at 106 and is preceded by a coded speech frame (m−2), which is not illustrated, corresponding to the input frame (m−2). FIG. 1 also illustrates, at 108, overlapping coded generic audio frames. The generic audio analysis/synthesis windows correspond to the amplitude envelope of the processed generic audio frame. The sequence of processed frames 106 and 108 are offset in time relative to the sequence of input frames 102 due to algorithmic processing delay, also referred to herein as look-ahead delay and overlap-add delay for the speech and generic audio frames, respectively. The overlapping portions of the coded generic audio frames (m) and (m+1) at 108 in FIG. 1 provide an additive effect on the corresponding sequential processed generic audio frames (m) and (m+1) at 110. However, the leading tail of the coded generic audio frame (m) at 108 does not overlap with a trailing tail of an adjacent generic audio frame since the preceding frame is a coded speech frame. Thus the leading portion of the corresponding processed generic audio frame (m) at 108 has reduced amplitude. The result of combining the sequence of coded speech and generic audio frames is an audio gap between the processed speech frame and the processed generic audio frame in the sequence of processed output frames, as shown in the composite output frames at 110.

U.S. Publication No. 2006/0173675 entitled "Switching Between Coding Schemes" (Nokia) discloses a hybrid coder that accommodates both speech and music by selecting, on a frame-by-frame basis, between an adaptive multi-rate wideband (AMR-WB) codec and a codec utilizing a modified discrete cosine transform (MDCT), for example, an MPEG 3 codec or a (AAC) codec, whichever is most appropriate. Nokia ameliorates the adverse affect of discontinuities that occur as a result of un-canceled aliasing error arising when switching from the AMR-WB codec to the MDCT based codec using a special MDCT analysis/synthesis window with a near perfect reconstruction property, which is characterized by minimization of aliasing error. The special MDCT analysis/synthesis window disclosed by Nokia comprises three constituent overlapping sinusoidal based windows, $H_0(n)$, $H_1(n)$ and $H_2(n)$ that are applied to the first input music frame following a speech frame to provide an improved processed music frame. This method, however, may be subject to signal discontinuities that may arise from under-modeling of the associated spectral regions defined by $H_0(n)$, $H_1(n)$ and $H_2(n)$. That is, the limited number of bits that may be available need to be distributed across the three regions, while still being required to produce a nearly perfect waveform match between the end of the previous speech frame and the beginning of region $H_0(n)$.

The various aspects, features and advantages of the invention will become more fully apparent to those having ordinary skill in the art upon careful consideration of the following Detailed Description thereof with the accompanying drawings described below. The drawings may have been simplified for clarity and are not necessarily drawn to scale.

BRIEF DESCRIPTION OF THE DRAWINGS

Prior art

DETAILED DESCRIPTION

Figure 1:
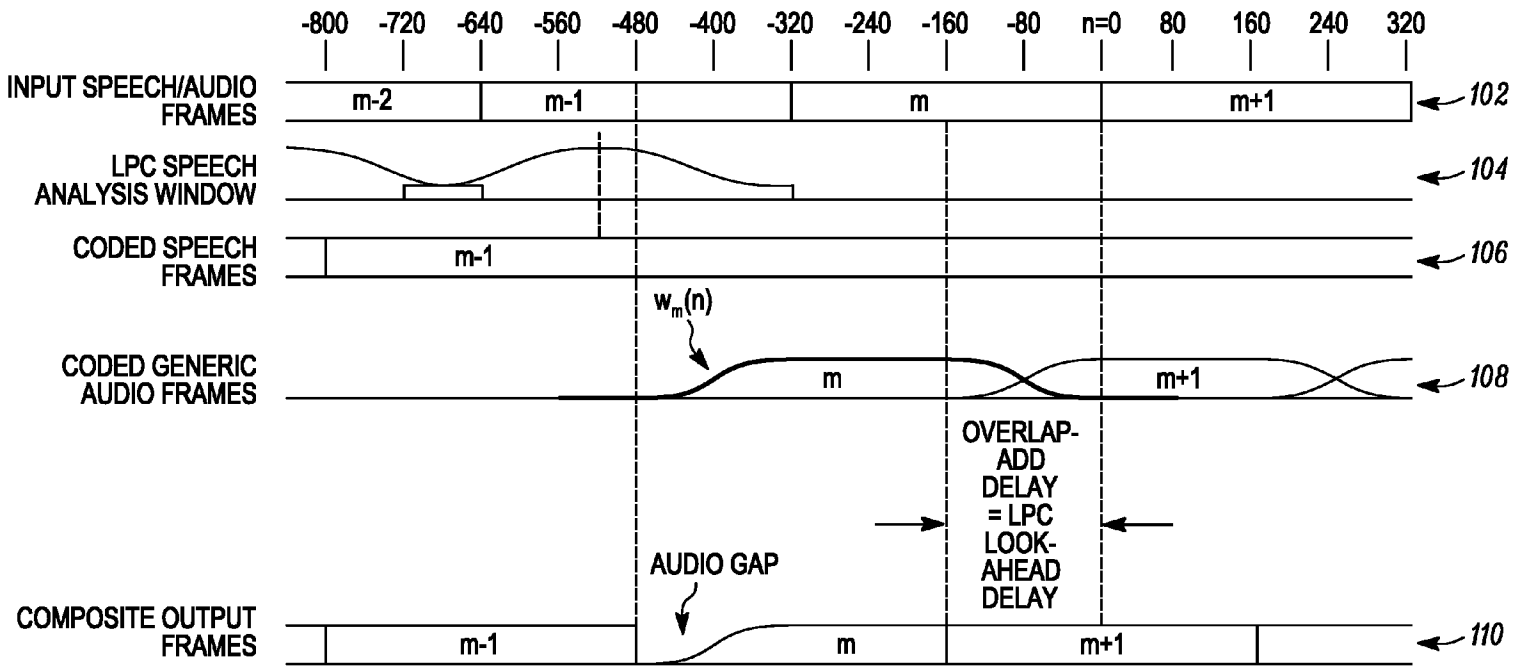
PRIOR ART FIG. 1
FIG. 1 illustrates a conventionally processed sequence of speech and generic audio frames having an audio gap.
Figure 2:
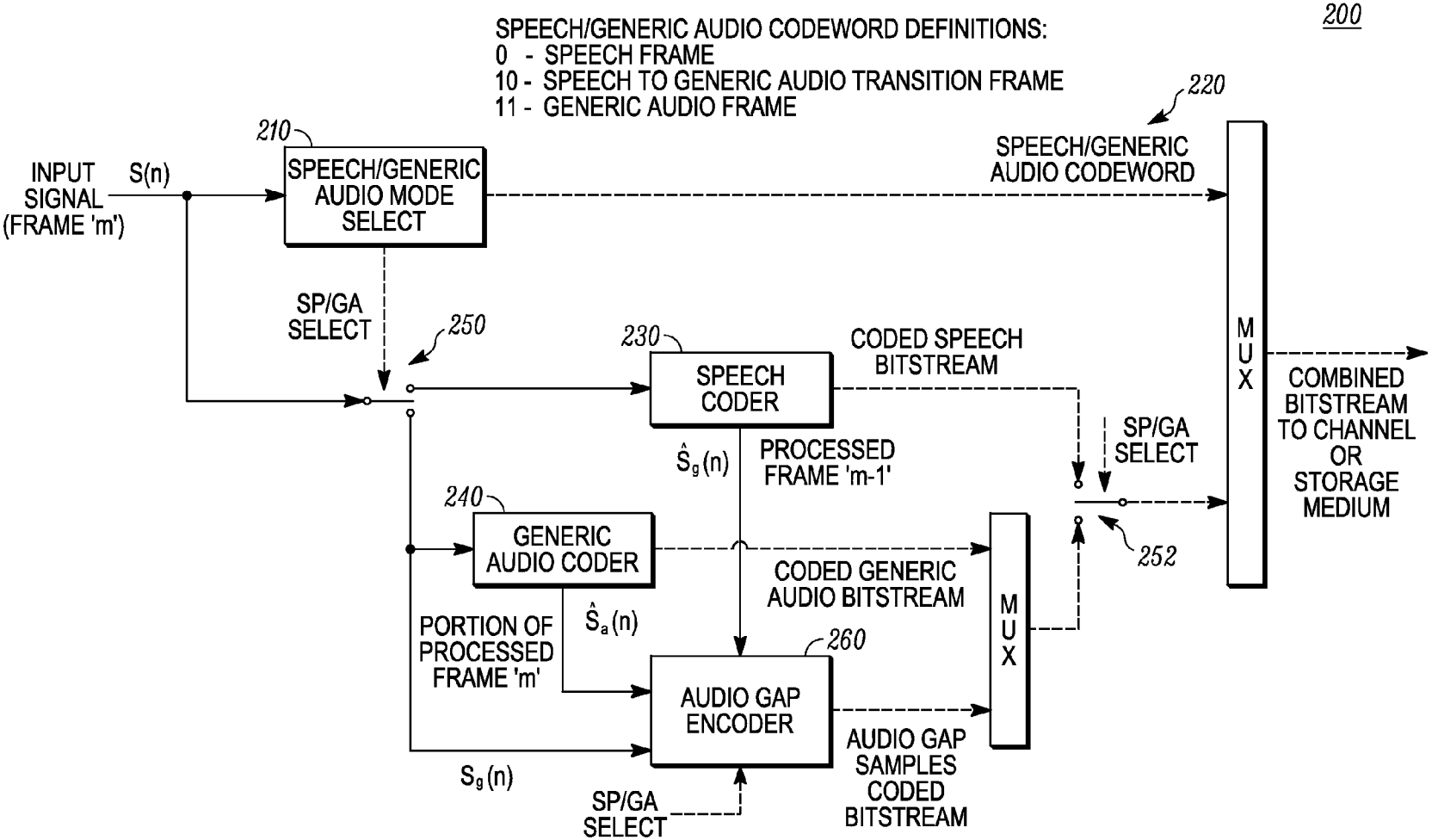
FIG. 2 is a schematic block diagram of a hybrid speech and generic audio signal coder.

FIG. 2 illustrates a hybrid core coder 200 configured to code an input stream of frames some of which are speech frames and others of which are less speech-like frames. The less speech like frames are referred to herein as generic audio frames. The hybrid core codec comprises a mode selector 210 that processes frames of an input audio signal s(n), where n is the sample index. Frame lengths may comprise 320 samples of audio when the sampling rate is 16 k samples per second, which corresponds to a frame time interval of 20 milliseconds, although many other variations are possible. The mode selector is configured to assess whether a frame in the sequence of input frames is more or less speech-like based on an evaluation of attributes or characteristics specific to each frame. The details of audio signal discrimination or more generally audio frame classification are beyond the scope of the instant disclosure but are well known to those having ordinary skill in the art. A mode selection codeword is provided to a multiplexor 220. The codeword indicates, on a frame by frame basis, the mode by which a corresponding frame of the input signal was processed. Thus, for example, an input audio frame may be processed as a speech signal or as a generic audio signal, wherein the codeword indicates how the frame was processed and particularly what type of audio coder was used to process the frame. The codeword may also convey information regarding a transition from speech to generic audio. Although the transition information may be implied from the previous frame classification type, the channel over which the information is transmitted may be lossy and therefore information about the previous frame type may not be available.

In FIG. 2, the codec generally comprises a first coder 230 suitable for coding speech frames and a second coder 240 suitable for coding generic audio frames. In one embodiment, the speech coder is based on a source-filter model suitable for processing speech signals and the generic audio coder is a linear orthogonal lapped transform based on time domain aliasing cancellation (TDAC). In one implementation, the speech coder may utilize Linear Predictive Coding (LPC) typical of a Code Excited Linear Predictive (CELP) coder, among other coders suitable for processing speech signals. The generic audio coder may be implemented as Modified Discrete Cosine Transform (MDCT) codec or a Modified Discrete Sine Transform (MSCT) or forms of the MDCT based on different types of Discrete Cosine Transform (DCT) or DCT/Discrete Sine Transform (DST) combinations.

In FIG. 2, the first and second coders 230 and 240 have inputs coupled to the input audio signal by a selection switch 250 that is controlled based on the mode selected or determined by the mode selector 210. For example, the switch 250 may be controlled by a processor based on the codeword output of the mode selector. The switch 250 selects the speech coder 230 for processing speech frames and the switch selects the generic audio coder for processing generic audio frames. Each frame may be processed by only one coder, e.g., either the speech coder or the generic audio coder, by virtue of the selection switch 250. More generally, while only two coders are illustrated in FIG. 2, the frames may be coded by one of several different coders. For example, one of three or more coders may be selected to process a particular frame of the input audio signal. In other embodiments, however, each frame may be coded by all coders as discussed further below.

In FIG. 2, each codec produces an encoded bitstream and a corresponding processed frame based on the corresponding input audio frame processed by the coder. The processed frame produced by the speech coder is indicated by $\hat{s}_s(n)$, while the processed frame produced by the generic audio coder is indicated by $\hat{s}_a(n)$.

In FIG. 2, a switch 252 on the output of the coders 230 and 240 couples the coded output of the selected coder to the multiplexer 220. More particularly, the switch couples the encoded bitstream output of the coder to the multiplexor. The switch 252 is also controlled based on the mode selected or determined by the mode selector 210. For example, the switch 252 may be controlled by a processor based on the codeword output of the mode selector. The multiplexor multiplexes the codeword with the encoded bitstream output of the corresponding coder selected based on the codeword. Thus for generic audio frames the switch 252 couples the output of the generic audio coder 240 to the multiplexor 220, and for speech frames the switch 252 couples the output of the speech coder 230 to the multiplexor. In the case where a generic audio frame coding process follows a speech encoding process, a special "transition mode" frame is utilized in accordance with the present disclosure. The transition mode encoder comprises generic audio coder 240 and audio gap encoder 260, the details of which are described as follows.

Figure 4:
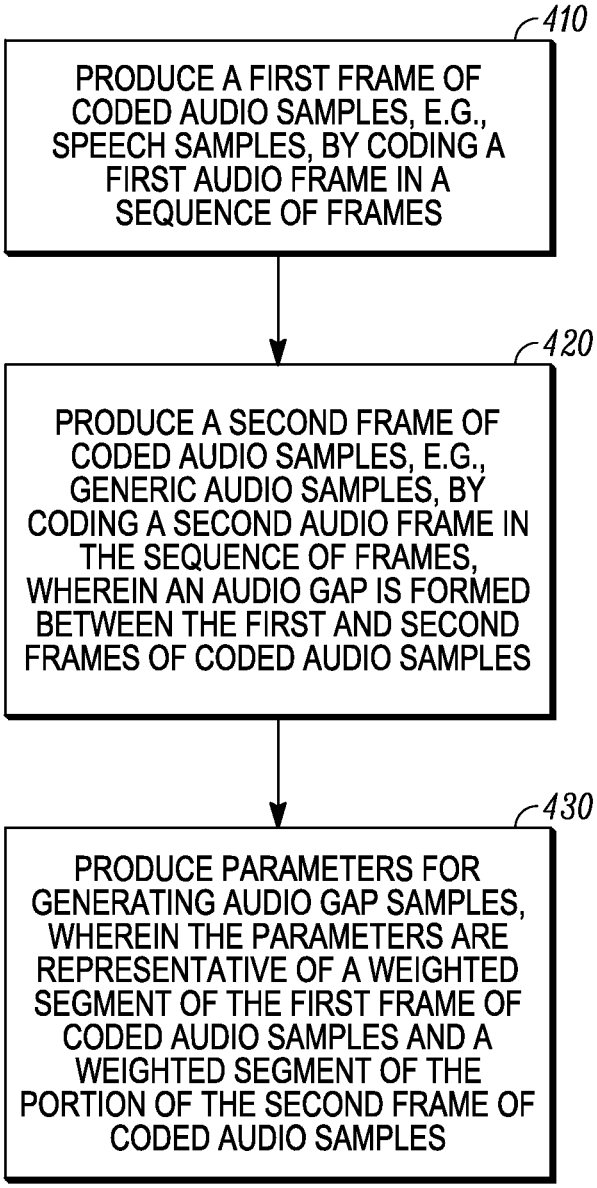
FIG. 4 illustrates an audio signal encoding process.
Figure 5:
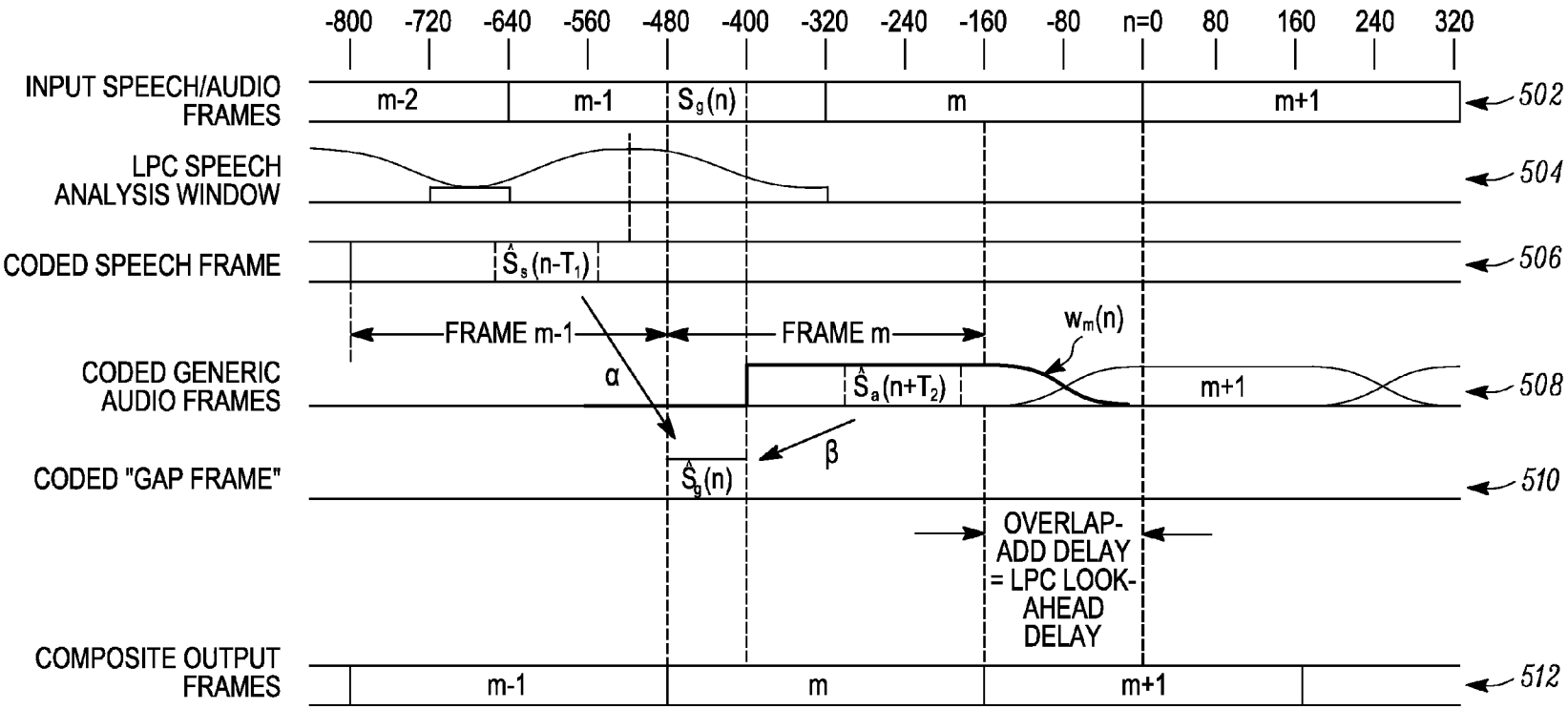
FIG. 5 illustrates a sequence of speech and generic audio frames subject to a non-conventional coding process.

FIG. 4 illustrates a coding process 400 implemented in a hybrid audio signal processing codec, for example the hybrid codec of FIG. 2. At 410, a first frame of coded audio samples is produced by coding a first audio frame in a sequence of frames. In the exemplary embodiment, the first coded frame of audio samples is a coded speech frame produced or generated using a speech codec. In FIG. 5, an input speech/audio frame sequence 502 comprises sequential speech frames (m−2) and (m−1) and a subsequent generic audio frame (m). The speech frames (m−2) and (m−1) may be coded based in part on LPC analysis windows, both illustrated at 504. A coded speech frame corresponding to the input speech frame (m−1) is illustrated at 506. This frame may be preceded by another coded speech frame, not illustrated, corresponding to the input frame (m−2). The coded speech frames are delayed relative to the corresponding input frames by an interval resulting from algorithmic delay associated with the LPC "look-ahead" processing buffer, i.e., the audio samples ahead of the frame that are required to estimate the LPC parameters that are centered around the end (or near the end) of the coded speech frame.

In FIG. 4, at 420, at least a portion of a second frame of coded audio samples is produced by coding at least a portion of a second audio frame in the sequence of frames. The second frame is adjacent the first frame. In the exemplary embodiment, the second coded frame of audio samples is a coded generic audio frame produced or generated using a generic audio codec. In FIG. 5, frame "m" in the input speech/audio frame sequence 502 is a generic audio frame that is coded based on a TDAC based linear orthogonal lapped transform analysis/synthesis window (m) illustrated at 508. A subsequent generic audio frame (m+1) in the sequence of input frames 502 is coded with an overlapping analysis/synthesis window (m+1) illustrated at 508. In FIG. 5, the generic audio analysis/synthesis windows correspond in amplitude to the processed generic audio frame. The overlapping portions of the analysis/synthesis windows (m) and (m+1) at 508 in FIG. 5 provide an additive effect on the corresponding sequential processed generic audio frames (m) and (m+1) of the input frame sequence. The result is that the trailing tail of the processed generic audio frame corresponding to the input frame (m) and the leading tail of the adjacent processed frame corresponding to input frame (m+1) are not attenuated.

In FIG. 5, since the generic audio frames (m) is processed using an MDCT coder and the previous speech frame (m−1) was processed using an LPC coder, the MDCT output in the overlap region between −480 and −400 is zero. It is not known how to have alias free generation of all 320 samples of the generic audio frame (m), and at the same time generate some samples for overlap add with the MDCT output of the subsequent generic audio frame (m+1) using the MDCT of the same order as the MDCT order of the regular audio frame. According to one aspect of the disclosure, compensation is provided for the audio gap that would otherwise occur between a processed generic audio frame following a processed speech frame, as discussed below.

In order to insure proper alias cancellation, the following properties must be exhibited by the complementary windows within the M sample overlap-add region:

$$w_{m-1}^2(M+n)+w_m^2(n)=1,\ 0\leqq n\leqq M,\ \text{and} \tag{1}$$

$$w_{m-1}(M+n)w_{m-1}(2M-n-1)-w_m(n)w_m(M-n-1)=0,\quad 0\leqq n\leqq M, \tag{2}$$

where m in the current frame index, n is the sample index within the current frame, $w_m(n)$ is the corresponding analysis and synthesis window at frame m, and M is the associated frame length. A common window shape which satisfies the above criteria is given as:

$$w(n)=\sin\left[\left(n+\frac{1}{2}\right)\frac{\pi}{2M}\right],\quad 0\leq n<2M, \tag{3}$$

However, it is well know that many window shapes may satisfy these conditions. For example, in the present disclosure, the algorithmic delay of the generic audio coding overlap-add process is reduced by zero-padding the 2M frame structure as follows:

$$w(n)=\begin{cases}0, & 0\leq n<\frac{M}{4},\\ \sin\left[\left(n-\frac{M}{4}+\frac{1}{2}\right)\frac{\pi}{M}\right], & \frac{M}{4}\leq n<\frac{3M}{4},\\ 1, & \frac{3M}{4}\leq n<\frac{5M}{4},\\ \cos\left[\left(n-\frac{5M}{4}+\frac{1}{2}\right)\frac{\pi}{M}\right], & \frac{5M}{4}\leq n<\frac{7M}{4},\\ 0, & \frac{7M}{4}\leq n<2M,\end{cases} \tag{4}$$

This reduces algorithmic delay by allowing processing to begin after acquisition of only 3M/2 samples, or 480 samples for a frame length of M=320. Note that while w (n) is defined for 2M samples (which is required for processing an MDCT structure have 50% overlap-add), only 480 samples are needed for processing.

Returning to Equations (1) and (2) above, if the previous frame (m−1) were a speech frame and the current frame (m) were a generic audio frame, then there would be no overlap-add data and essentially the window from frame (m−1) would be zero, or $w_{m-1}(M+n)=0$, $0\leqq n\leqq M$. Equations (1) and (2) would therefore become:

$$w_m^2(n)=1,\ 0\leqq n\leqq M,\ and \tag{5}$$

$$w_m(n)w_m(M-n-1)=0,\ 0\leqq n\leqq M. \tag{6}$$

From these revised equations it is apparent that the window function in Equations (3) and (4) does no satisfy these constraints, and in fact the only possible solution for Equations (5) and (6) that exists is for the interval $M/2\leqq n\leqq M$ as:

$$w_m(n)=1,\ M/2\leqq n<M,\ \text{and} \tag{7}$$

$$w_m(n)=0,\ 0\leqq n<M/2. \tag{8}$$

So, in order to insure proper alias cancellation, the speech-to-audio frame transition window is given in the present disclosure as:

$$w(n)=\begin{cases}0, & 0\leq n<\frac{M}{2},\\ 1, & \frac{M}{2}\leq n<\frac{5M}{4},\\ \cos\left[\left(n-\frac{5M}{4}+\frac{1}{2}\right)\frac{\pi}{2M}\right], & \frac{5M}{4}\leq n<\frac{7M}{4},\\ 0, & \frac{7M}{4}\leq n<2M,\end{cases} \tag{9}$$

and is shown in FIG. 5 at (508) for frame m. The "audio gap" is then formed as the samples corresponding to $0\leqq n<M/2$, which occur after the end of the speech frame (m−1), are forced to zero.

In FIG. 4, at 430, parameters for generating audio gap filler samples or compensation samples are produced, wherein the audio gap filler samples may be used to compensate for the audio gap between the processed speech frame and the processed generic audio frame. The parameters are generally multiplexed as part of the coded bitstream and stored for later use or communicated to the decoder, as described further below. In FIG. 2 we call them the "audio gap samples coded bitstream". In FIG. 5, the audio gap filler samples constitute a coded gap frame indicated by syn) as discussed further below. The parameters are representative of a weighted segment of the first frame of coded audio samples and/or a weighted segment of the portion of the second frame of coded audio samples. The audio gap filler samples generally constitute a processed audio gap frame that fills the gap between the processed speech frame and the processed generic audio frame. The parameters may be stored or communicated to another device and used to generate the audio gap filler samples, or frame, for filling the audio gap between the processed speech frame and the processed generic audio frame, as described further below. The encoder does not necessarily generate the audio gap filler samples although in some use cases it is desirable to generate audio gap filler samples at the encoder.

In one embodiment, the parameters include a first weighting parameter and a first index for a weighted segment of the first frame, e.g., the speech frame, of coded audio samples, and a second weighting parameter and a second index for a weighted segment of the portion of the second frame, e.g., the generic audio frame, of coded audio samples. The parameters may be constant values or functions. In one implementation, the first index specifies a first time offset from a reference audio gap sample in the sequence of input frames to a corresponding sample in the segment of the first frame of coded audio samples (e.g., the coded speech frame), and the second index specifies a second time offset from the reference audio gap sample to a corresponding sample in the segment of the portion of the second frame of coded audio samples (e.g., the coded generic speech frame). The first weighting parameter comprises a first gain factor that is applied to the corresponding samples in the indexed segment of the first frame. Similarly, the second weighting parameter comprises a second gain factor that is applied to the corresponding samples in the indexed segment of the portion of the second frame. In FIG. 5, the first offset is $T_1$ and the second offset is $T_2$. Also in FIG. 5, $\alpha$ represents the first weighting parameter and $\beta$ represents the second weighting parameter. The reference audio gap sample could be any location in the audio gap between the coded speech frame and the coded generic audio frame, for example, the first or last locations or a sample there between. We refer to the reference gap samples as $s_g(n)$, where n=0, . . . , L−1, and L is the number of gap samples.

The parameters are generally selected to reduce distortion between the audio gap filler samples that are generated using the parameters and a set of samples, $s_g(n)$, in the sequence of frames corresponding to the audio gap, wherein the set of samples are referred to as a set of reference audio gap samples. Thus generally the parameters may be based on a distortion metric that is a function of a set of reference audio gap samples in the sequence of input frames. In one embodiment, the distortion metric is a squared error distortion metric. In another embodiment, the distortion metric is a weighted mean squared error distortion metric.

In one particular implementation, the first index is determined based on a correlation between a segment of the first frame of coded audio samples and a segment of reference audio gap samples in the sequence of frames. The second index is also determined based on a correlation between a segment of the portion of the second frame of coded audio samples and the segment of reference audio gap samples. In FIG. 5, the first offset and weighted segment $\alpha\cdot\hat{s}_s(n-T_1)$ are determined by correlating the set of reference gap samples $s_g(n)$ in the sequence of frames 502 with the coded speech frame at 506. Similarly, the second offset and weighted segment $\beta\cdot\hat{s}_a(n+T_2)$ are determined by correlating the set of samples $s_g(n)$ in the sequence of frames 502 with the coded generic audio frame at 508. Thus generally, the audio gap filler samples are generated based on specified parameters and based on the first and/or second frames of coded audio samples. The coded gap frame $\hat{s}_g(n)$ comprising such coded audio gap filler samples is illustrated at 510 in FIG. 5. In one embodiment, where the parameters are representative of both the weighted segment of the first and second frames of coded audio samples, the audio gap filler samples of the coded gap frame are represented by $\hat{s}_g(n)=\alpha\cdot\hat{s}_s(n-T_1)+\beta\cdot\hat{s}_a(n+T_2)$. The coded gap frame samples syn) may be combined with the coded generic audio frame (m) to provide a relatively continuous transition with the coded speech frame (m−1) as illustrated at 512 in FIG. 5.

The details for determining the parameters associated with the audio gap filler samples are discussed below. Let $s_g$ be an input vector of length L=80 representing a gap region. The gap region is coded by generating an estimate $\hat{s}_g$ from the speech frame output $\hat{s}_s$ of the previous frame (m−1) and the portion of the generic audio frame output $\hat{s}_a$ of the current frame (m). Let $\hat{s}_s(-T)$ be a vector of length L starting from $T^{th}$ past sample of $\hat{s}_s$ and $\hat{s}_a(T)$ be a vector of length L starting from the $T^{th}$ future sample of $\hat{s}_a$ (see FIG. 5). The vector $\hat{s}_g$ may then be obtained as:

$$\hat{s}_g=\alpha\cdot\hat{s}_s(-T_1)+\beta\cdot\hat{s}_a(T_2), \tag{10}$$

where $T_1$, $T_2$, $\alpha$, and $\beta$ are obtained to minimize a distortion between $s_g$ and $\hat{s}_g$. $T_1$ and $T_2$ are integer valued where $160\leqq T_1\leqq 260$ and $0\leqq T_2\leqq 80$. Thus the total number of combinations for $T_1$ and $T_2$ are $101\times 81=8181<8192$ and hence they can be jointly coded using 13 bits. A 6 bit scalar quantizer is used for coding each of the parameters $\alpha$ and $\beta$. The gap is coded using 25 bits.

A method for determining these parameters is given as follows. A weighted mean squared error distortion is first given by:

$$D=|s_g-\hat{s}_g|^T\cdot W\cdot|s_g-\hat{s}_g|, \tag{11}$$

where W is a weighting matrix used for finding optimal parameters, and T denotes the vector transpose. W is a positive definite matrix and is preferably a diagonal matrix. If W is an identity matrix, then the distortion is a mean squared distortion.

We can now define the self and cross correlation between the various terms of Equation (11) as:

$$R_{gs}=s_g^T\cdot W\cdot\hat{s}_s(-T_1), \tag{12}$$

$$R_{ga}=s_g^T\cdot W\cdot\hat{s}_a(T_2), \tag{13}$$

$$R_{aa}=\hat{s}_a(T_2)^T\cdot W\cdot\hat{s}_a(T_2), \tag{14}$$

$$R_{ss}=\hat{s}_a(-T_1)^T\cdot W\cdot\hat{s}_s(-T_1), \text{ and} \tag{15}$$

$$R_{as}=\hat{s}_a(T_2)^T\cdot W\cdot\hat{s}_s(-T). \tag{16}$$

From these, we can further define the following:

$$\delta(T_1,T_2)=R_{ss}R_{aa}-R_{as}R_{as}, \tag{17}$$

$$\eta(T_1,T_2)=R_{aa}R_{gs}-R_{as}R_{ga}, \tag{18}$$

$$\gamma(T_1,T_2)=R_{ss}R_{ga}-R_{as}R_{gs}. \tag{19}$$

The values of $T_1$ and $T_2$ which minimize the distortion in Equation (10) are the values of $T_1$ and $T_2$ which maximize:

$$S=(\eta\cdot R_{gs}+\gamma\cdot R_{ga})/\delta. \tag{20}$$

Now let $T_1$* and $T_2$* be the optimum values which maximizes the expression in (20) then the coefficients $\alpha$ and $\beta$ in Equation (10) are obtained as:

$$\alpha=\eta(T_1^*,T_2^*)/\delta(T_1^*,T_2^*) \text{ and} \tag{21}$$

$$\beta=\gamma(T_1^*,T_2^*)/\delta(T_1^*,T_2^*). \tag{22}$$

The values of $\alpha$ and $\beta$ are subsequently quantized using six bit scalar quantizers. In an unlikely case where for certain values of $T_1$ and $T_2$, the determinant g in Equation (20) is zero, the expression in Equation (20) is evaluated as:

$$S=R_{gs}R_{gs}/R_{ss},\ R_{ss}>0, \tag{23}$$

or $$S=R_{ga}R_{ga}/R_{aa},\ R_{aa}>0. \tag{24}$$

If both $R_{ss}$ and $R_{aa}$ are zero, then S is set to a very small value.

A joint exhaustive search method for $T_1$ and $T_2$ has been described above. The joint search is generally complex however various relatively low complexity approaches may be adopted for this search. For example, the search for $T_1$ and $T_2$ can be first decimated by a factor greater than 1 and then the search can be localized. A sequential search may also be used, where a few optimum values of $T_1$ are first obtained assuming $R_{ga}=0$, and then $T_2$ is searched only over those values of $T_1$.

Using a sequential search as described above also gives rise to the case where either the first weighted segment $\alpha\cdot\hat{s}_s(-T_1)$ or the second weighted segment $\beta\cdot\hat{s}_a(T_2)$ may be used to construct the coder audio gap filler samples represented $\hat{s}_g$. That is, in one embodiment, it is possible that only one set of parameters for the weighted segments is generated and used by the decoder to reconstruct the audio gap filler samples. Furthermore, there may be embodiments which consistently favor one weighted segment over the other. In such cases, the distortion may be reduced by considering only one of the weighted segments.

Figure 6:
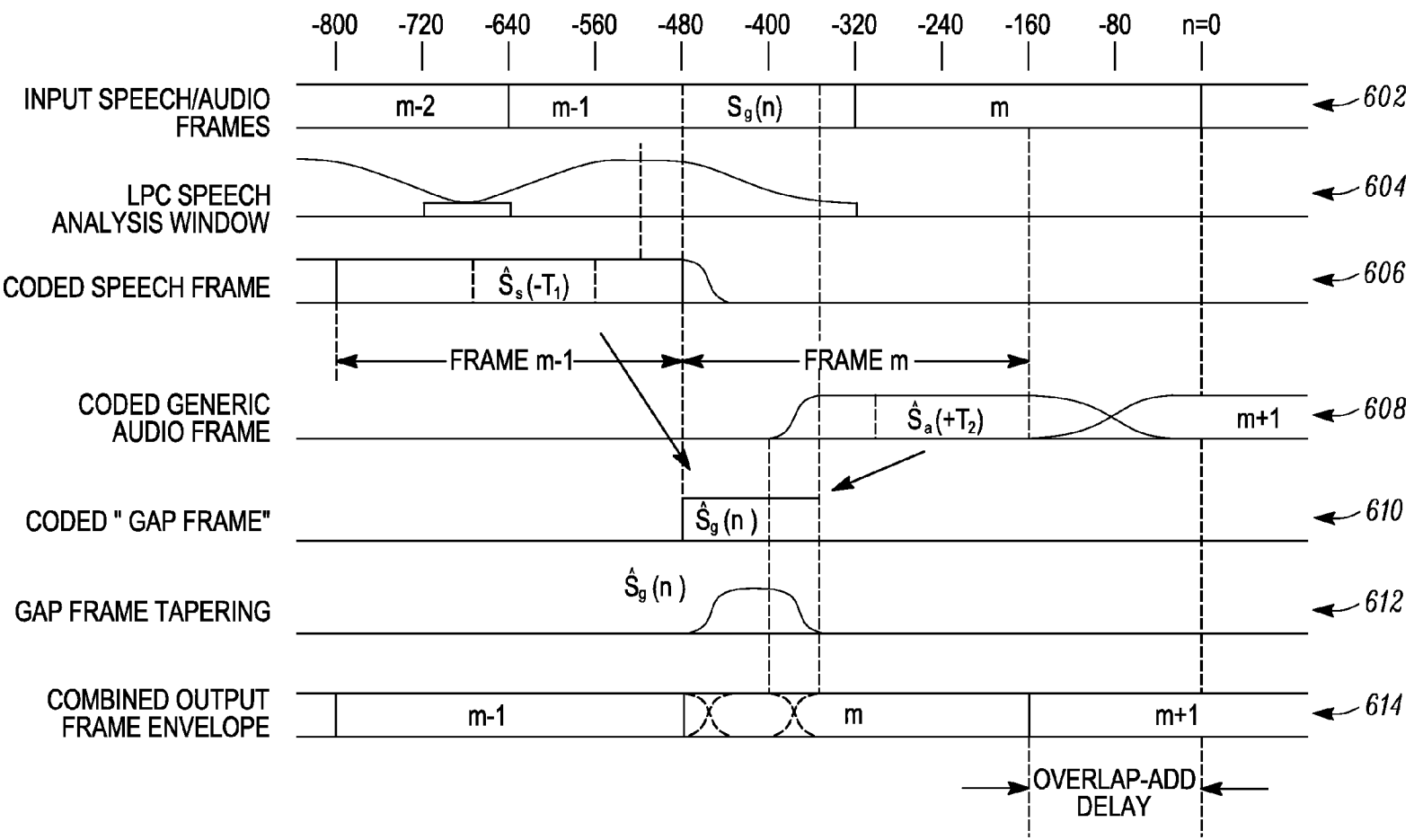
FIG. 6 illustrates a sequence of speech and generic audio frames subject to another non-conventional coding process.

In FIG. 6, the input speech and audio frame sequence 602, the LPC speech analysis window 604, and the coded gap frame 610 are the same as in FIG. 5. In one embodiment, the trailing tail of the coded speech frame is tapered, as illustrated at 606 in FIG. 6, and the leading tail of the coded gap frame is tapered as illustrated in 612. In another embodiment, the leading tail of the coded generic audio frame is tapered, as illustrated at 608 in FIG. 6, and the trailing tail of the coded gap frame is tapered as illustrated in 612. Artifacts related to time-domain discontinuities are likely reduced most effectively when both the leading and trailing tails the coded gap frame are tapered. In some embodiments, however, it may be beneficial to taper only the leading tail or the trailing tail of the coded gap frame, as described further below. In other embodiment, there is no tapering. In FIG. 6, at 614, the combine output speech frame (m−1) and the generic frame (m) include the coded gap frame having the tapered tails.

In one implementation, with reference to FIG. 5, not all samples of the generic audio frame (m) at 502 are included in the generic audio analysis/synthesis window at 508. In one embodiment, the first L samples of the generic audio frame (m) at 502 are excluded from the generic audio analysis/synthesis window. The number of samples excluded depends generally on the characteristic of the generic audio analysis/synthesis window forming the envelope for the processed generic audio frame. In one embodiment, the number of samples that are excluded is equal to 80. In other embodiments, a fewer or a greater number of samples may be excluded. In the present example, the length of the remaining, non-zero region of the MDCT window is L less than the length of the MDCT window in regular audio frames. The length of the window in the generic audio frame is equal to the sum of the length of the frame and the look-ahead length. In one embodiment the length of the transition frame is 320−80+160=400 instead of 480 for the regular audio frames.

If an audio coder could generate all the samples of the current frame without any loss, then a window with the left end having a rectangular shape is preferred. However, using a window with a rectangular shape may result in more energy in the high frequency MDCT coefficients, which may be more difficult to code without significant loss using a limited number of bits. Thus, to have a proper frequency response, a window having a smooth transition (with an $M_1$=50 sample sine window on left and M/2 samples cosine window on right) is used. This is described as:

$$w(n)=\begin{cases}0, & 0\le n<\frac{M}{2},\\ \sin\left[\left(n-\frac{M}{2}+\frac{1}{2}\right)\frac{\pi}{2M_1}\right], & \frac{M}{2}\le n<\frac{M}{2}+M_1,\\ 1, & \frac{M}{2}+M_1\le n<\frac{5M}{4},\\ \cos\left[\left(n-\frac{5M}{4}+\frac{1}{2}\right)\frac{\pi}{M}\right], & \frac{5M}{4}\le n<\frac{7M}{4},\\ 0, & \frac{7M}{4}\le n<2M,\end{cases} \tag{25}$$

In the present example, a gap of 80+$M_1$ samples is coded using an alternative method to that described previously. Since a smooth window with a transition region of 50 samples is used instead of a rectangular or step window, the gap region to be coded using an alternate method is extended by $M_1$=50 samples, thereby making the length of the gap region 130 samples. The same forward/backward prediction approach discussed above is used for generating these 130 samples.

Weighted mean square methods are typically good for low frequency signals and tend to decrease the energy of high frequency signals. To decrease this effect, the signals $\hat{s}_s$, and $\hat{s}_a$ may be passed through a first order pre-emphasis filter (pre-emphasis filter coefficient=0.1) before generating $\hat{s}_g$ in Equation (10) above.

The audio mode output $\hat{s}_a$ may have a tapering analysis and synthesis window and hence $\hat{s}_a$ for delay $T_2$ such that $\hat{s}_a(T_2)$ overlaps with the tapering region of $\hat{s}_a$. In such situations, the gap region $s_g$ may not have a very good correlation with $\hat{s}_a(T_2)$. In such a case, it may be preferable to multiply $\hat{s}_a$ with an equalizer window E to get an equalized audio signal:

$$\hat{s}_{ae}=E\cdot\hat{s}_a, \tag{26}$$

Instead of using $\hat{s}_a$, this equalized audio signal may now be used in Equation (10) and discussion following Equation (10).

The Forward/Backward estimation method used for coding of the gap frame generally produces a good match for the gap signal but it sometimes results in discontinuities at both the end points, i.e., at the boundary of the speech part and gap regions as well at the boundary between the gap region and the generic audio coded part (see FIG. 5). Thus, in some embodiments, to decrease the effect of discontinuity at the boundary of the speech part and the gap part, the output of the speech part is first extended, for example by 15 samples. The extended speech may be obtained by extending the excitation using frame error mitigation processing in the speech coder, which is normally used to reconstruct frames that are lost during transmission. This extended speech part is overlap added (trapezoidal) with the first 15 samples of $\hat{s}_g$ to obtain smoothed transition at the boundary of speech part and the gap.

For the smoothed transition at the boundary of the gap and the MDCT output of the speech to audio switching frame, the last 50 samples of $\hat{s}_g$ are first multiplied by $(1-w_m^2)$) and then added to first 50 samples of $\hat{s}_a$.

Figure 3:
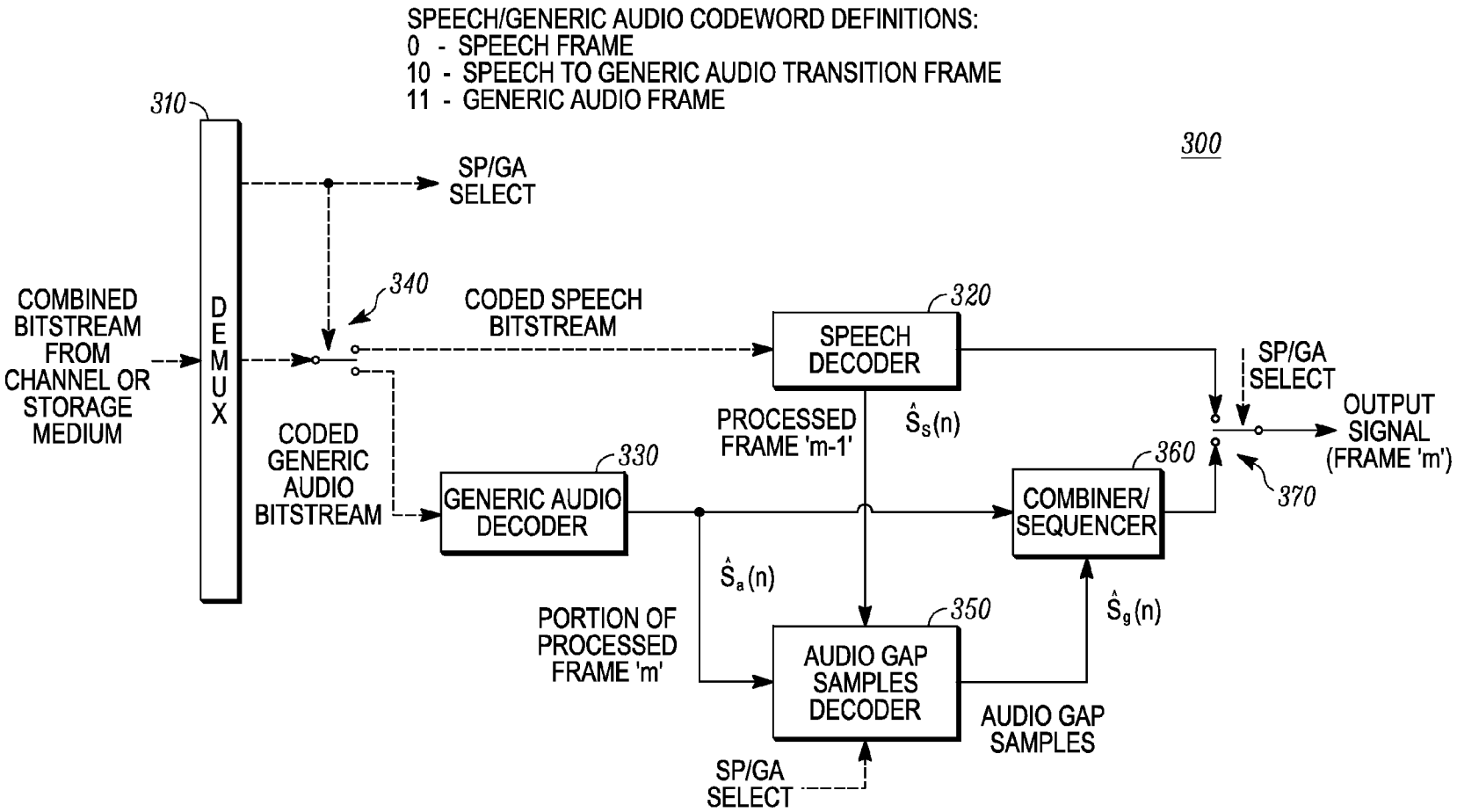
FIG. 3 is a schematic block diagram of a hybrid speech and generic audio signal decoder.

FIG. 3 illustrates a hybrid core decoder 300 configured to decode an encoded bitstream, for example, the combined bitstream encoded by the coder 200 of FIG. 2. In some implementations, most typically, the coder 200 of FIG. 2 and the decoder 300 of FIG. 3 are combined to form a codec. In other implementations, the coder and decoder may be embodied or implemented separately. In FIG. 3, a demultiplexer separates constituent elements of a combined bitstream. The bitstream may be received from another entity over a communication channel, for example, over a wireless or wire-line channel, or the bitstream may be obtained from a storage medium accessible to or by the decoder. In FIG. 3, the combined bitstream is separated into a codeword and a sequence of coded audio frames comprising speech and generic audio frames. The codeword indicates on a frame-by-frame basis whether a particular frame in the sequence is a speech (SP) frame or generic audio (GA) frame. Although the transition information may be implied from the previous frame classification type, the channel over which the information is transmitted may be lossy and therefore information about the previous frame type may not be reliable or available. Thus in some embodiments, the codeword may also convey information regarding a transition from speech to generic audio.

In FIG. 3, the decoder generally comprises a first decoder 320 suitable for coding speech frames and a second coder 330 suitable for decoding generic audio frames. In one embodiment, the speech decoder is based on a source-filter model decoder suitable for processing decoding speech signals and the generic audio decoder is a linear orthogonal lapped transform decoder based on time domain aliasing cancellation (TDAC) suitable for decoding generic audio signals as described above. More generally, the configuration of the speech and generic audio decoders must complement that of the coder.

In FIG. 3, for a given audio frame one of the first and second decoders 320 and 330 have inputs coupled to the output of the demultiplexor by a selection switch 340 that is controlled based on the codeword or other means. For example, the switch may be controlled by a processor based on the codeword output of the mode selector. The switch 340 selects the speech decoder 320 for processing speech frames and the generic audio decoder 330 for processing generic audio frames, depending on the audio frame type output by the demultiplexor. Each frame is generally processed by only one coder, e.g., either the speech coder or the generic audio coder, by virtue of the selection switch 340. Alternatively, however, the selection may occur after decoding each frame by both decoders. More generally, while only two decoders are illustrated in FIG. 3, the frames may be decoded by one of several decoders.

Figure 7:
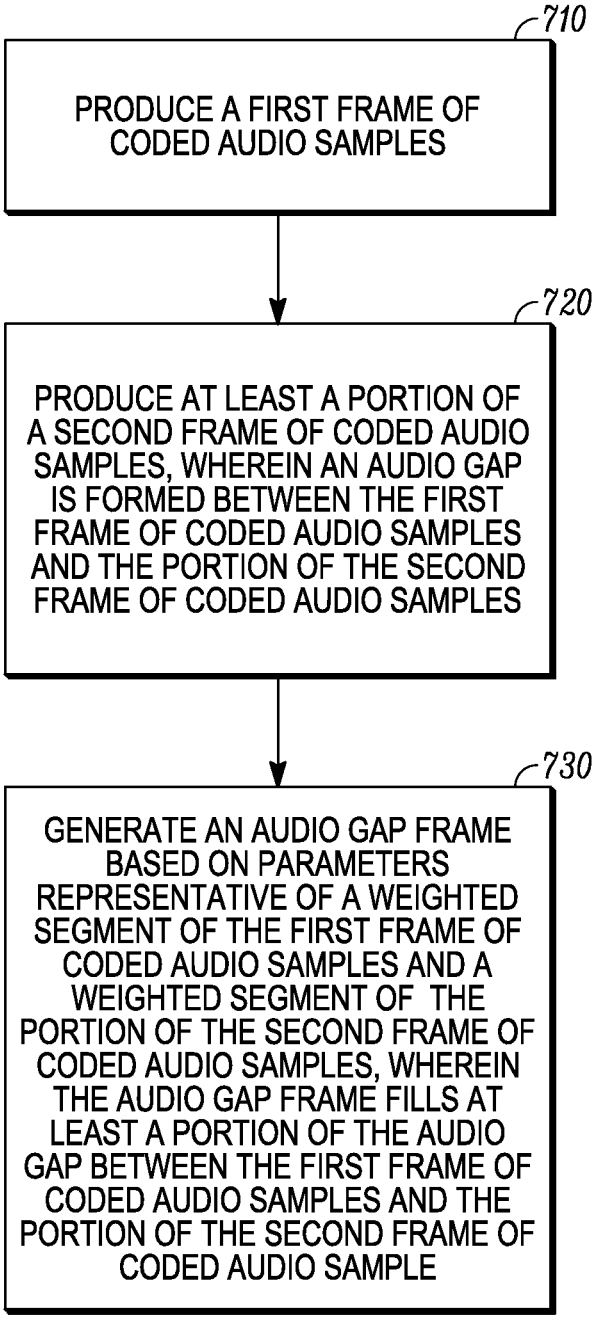
FIG. 7 illustrates an audio decoding process.

FIG. 7 illustrates a decoding process 700 implemented in a hybrid audio signal processing codec or at least the hybrid decoder portion of FIG. 3. The process also includes generation of an audio gap filler samples as described further below. In FIG. 7, at 710, a first frame of coded audio samples is produced and at 720 at least a portion of a second frame of coded audio samples is produced. In FIG. 3, for example, when the bitstream output from the demultiplxor 310 includes a coded speech frame and a coded generic audio frame, a first frame of coded samples is produced using the speech decoder 320 and then at least a portion of a second frame of coded audio samples is produced using the generic audio decoder 330. As described above, an audio gap is sometimes formed between the first frame of coded audio samples and the portion of the second frame of coded audio samples resulting in undesirable noise at the user interface.

At 730, audio gap filler samples are generated based on parameters representative of a weighted segment of the first frame of coded audio samples and/or a weighted segment of the portion of the second frame of coded audio samples. In FIG. 3, an audio gap samples decoder 350 generates audio gap filler samples $\hat{s}_g(n)$ from the processed speech frame $\hat{s}_s(n)$ generated by the decoder 320 and/or from the processed generic audio frame $\hat{s}_a(n)$ generated by the generic audio decoder 330 based on the parameters. The parameters are communicated to the audio gap decoder 350 as part of the coded bitstream. The parameters generally reduce distortion between the audio gap samples generated and a set of reference audio gap samples described above. In one embodiment, the parameters include a first weighting parameter and a first index for the weighted segment of the first frame of coded audio samples, and a second weighting parameter and a second index for the weighted segment of the portion of the second frame of coded audio samples. The first index specifies a first time offset from a the audio gap filler sample to a corresponding sample in the segment of the first frame of coded audio samples, and the second reference specifies a second time offset from the audio gap filler sample to a corresponding sample in the segment of the portion of the second frame of coded audio samples.

In FIG. 3, the audio filler gap samples generated by the audio gap decoder 350 are communicated to a sequencer 360 that combines the audio gap samples $\hat{s}_g(n)$ with the second frame of coded audio samples $\hat{s}_a(n)$ produced by the generic audio decoder 330. The sequencer generally forms a sequence of sample that includes at least the audio gap filler samples and the portion of the second frame of coded audio samples. In one particular implementation, the sequence also includes the first frame of coded audio samples, wherein the audio gap filler samples at least partially fill an audio gap between the first frame of coded audio samples and the portion of the second frame of coded audio samples.

The audio gap frame fills at least a portion of the audio gap between the first frame of coded audio samples and the portion of the second frame of coded audio sample, thereby eliminating or at least reducing any audible noise that may be perceived by the user. A switch 370 selects either the output of the speech decoder 320 or the combiner 360 based on the codeword, such that the decoded frames are recombined in an output sequence.

While the present disclosure and the best modes thereof have been described in a manner establishing possession and enabling those of ordinary skill to make and use the same, it will be understood and appreciated that there are equivalents to the exemplary embodiments disclosed herein and that modifications and variations may be made thereto without departing from the scope and spirit of the inventions, which are to be limited not by the exemplary embodiments but by the appended claims.

What is claimed is:

1. A method for decoding audio frames, the method comprising:

producing, using a first decoding method, a first frame of coded audio samples;

producing, using a second decoding method, at least a portion of a second frame of coded audio samples;

generating audio gap filler samples based on parameters representative of a weighted segment of the first frame of coded audio samples or a weighted segment of the portion of the second frame of coded audio samples;

forming a sequence including the audio gap filler samples and the portion of the second frame of coded audio samples; and generating the audio gap filler samples based on parameters representative of both the weighted segment of the first frame of coded audio samples and the weighted segment of the portion of the second frame of coded audio samples;

wherein the parameters are based on an expression:

$$\hat{s}_g=\alpha\cdot\hat{s}_s(-T_1)+\beta\cdot\hat{s}_a(T_2)$$

wherein $\alpha$ is a first weighting factor of a segment of the first frame of coded audio samples $\hat{s}_s(-T_1)$, $\beta$ is a second weighting factor for a segment of the portion of the second frame of coded audio samples $\hat{s}_\alpha(T_2)$, and $\hat{s}_s$ corresponds to the audio gap filler samples.

2. The method of claim 1 further comprising forming the sequence including the first frame of coded audio samples, wherein the audio gap filler samples at least partially fill an audio gap between the first frame of coded audio samples and the portion of the second frame of coded audio samples.

3. The method of claim 1, wherein:

the weighted segment of the first frame of coded audio samples includes a first weighting parameter and a first index for the weighted segment of the first frame of coded audio samples; and the weighted segment of the portion of the second frame of coded audio samples includes a second weighting parameter and a second index for the weighted segment of the portion of the second frame of coded audio samples.

4. The method of claim 3, wherein:

the first index specifies a first time offset from the audio gap filler sample to a corresponding sample in the first frame of coded audio samples; and the second index specifies a second time offset from the audio gap filler sample to a corresponding sample in the portion of the second frame of coded audio samples.

5. The method of claim 3, wherein:

the first index is based on a correlation between a segment of the first frame of coded audio samples and a segment of reference audio gap samples in the sequence of frames; and the second index is based on a correlation between a segment of the portion of the second frame of coded audio samples and the segment of reference audio gap samples.

6. The method of claim 1 wherein the parameters are based on a distortion metric that is a function of a set of reference audio gap samples, wherein the distortion metric is a squared error distortion metric.

7. The method of claim 1 wherein the parameters are based on a distortion metric that is a function of a set of reference audio gap samples, wherein the distortion metric is based on an expression:

$$D=|s_g-\hat{s}_g|^T\cdot|s_g-\hat{s}_g|$$

where $s_g$ is representative of the set of reference gap filler samples.

8. The method of claim 1 further comprising producing the portion of the second frame of coded audio samples using a generic audio coding method.

9. The method of claim 8 further comprising producing the first frame of coded audio samples using a speech coding method.

10. The method of claim 1, wherein the parameters are based on a distortion metric that is a function of a set of the reference gap filler samples.

11. The method of claim 1 further comprising producing the portion of the second frame of coded audio samples using a generic audio coding method.

12. The method of claim 11 further comprising producing the first frame of coded audio samples using a speech coding method.

13. The method of claim 1, further comprising generating the audio gap filler samples based on parameters selected to reduce distortion between the audio gap filler samples and a set of reference audio gap samples.

* * * * *